US005928117A

United States Patent [19]

Vittone et al.

[11] Patent Number: 5,928,117

[45] Date of Patent: Jul. 27, 1999

[54] MOTION-RESISTING EXERCISE APPARATUS UTILIZING CONCENTRIC FRAMES

[76] Inventors: Larry W. Vittone; Suzanne R. Vittone, both of Rte. 1, Box 55, Hurley, Wis. 54534

[21] Appl. No.: 08/729,497

[22] Filed: Oct. 11, 1996

[51] Int. Cl.[6] ..... A63B 21/00; A63B 69/34

[52] U.S. Cl. ..... 482/99; 482/10; 482/92; 473/441

[58] Field of Search ..... 482/10, 43, 51, 482/69, 89, 94, 92, 99–103, 112–114, 120, 129, 133, 135; 473/442, 443, FOR 125, 441

[56] References Cited

U.S. PATENT DOCUMENTS

| | | | |
|---|---|---|---|
| 829,580 | 8/1906 | Folsom | 473/441 |
| 1,204,017 | 11/1916 | Hinkey | 473/442 |
| 4,125,257 | 11/1978 | Lew | 482/43 |
| 4,431,184 | 2/1984 | Lew et al. | 482/102 X |
| 4,537,393 | 8/1985 | Kusch | 482/10 |
| 4,549,733 | 10/1985 | Salyer | 482/99 |
| 4,951,943 | 8/1990 | Farenholtz | 482/99 |
| 5,397,287 | 3/1995 | Lindfors | 482/92 |

*Primary Examiner*—John Mulcahy
*Attorney, Agent, or Firm*—Michael E. McKee

[57] ABSTRACT

An exercise apparatus includes an inner frame which the user attempts to move during an exercise routine performed with the apparatus and an outer frame which generally encompasses the inner frame. A tensioned cable joins the inner and outer frames and resists the movement of the inner frame relative to the outer frame during an exercise routine.

13 Claims, 5 Drawing Sheets

MOTION-RESISTING EXERCISE APPARATUS UTILIZING CONCENTRIC FRAMES

BACKGROUND OF THE INVENTION

This invention relates generally to exercise apparatus involving the movement of a component of the apparatus between two positions during an exercise routine and, more particularly, is concerned with such exercise apparatus wherein the movement of the component between the two positions is resisted.

There exists many types of exercise apparatus which employ means for resisting the exercise motions of a user, but few exist which include means for applying resistance to the user's motions while a component of the apparatus is moved along any of a number of three-dimensional directions.

Accordingly, it is an object of the present invention to provide a new and improved exercise apparatus wherein the exercise motions of a user are resisted while a component of the apparatus is moved in any of a number of three-dimensional directions to enhance the effectiveness of an exercise routine performed with the apparatus.

Another object of the present invention is to provide such an apparatus which accommodates exercise motions which simulate those of a blocker engaged in a game of football.

Still another object of the present invention is to provide such an apparatus which is uncomplicated in construction and effective in operation.

SUMMARY OF THE INVENTION

This invention resides in an exercise apparatus including means providing an inner frame which the user attempts to move during an exercise routine performed with the apparatus and means providing an outer frame which generally encompasses the inner frame and which is positionable in a stationary condition with respect to a support surface disposed adjacent the apparatus. The apparatus also includes resistance means associated with the inner frame and the outer frame for resisting movement of the inner frame relative to the outer frame. The resistance means includes a tensioned cable which is passed between the inner frame and the outer frame in an interwoven arrangement which accommodates movement of the inner frame relative to the outer frame while the tension of the cable resists such relative movement. Therefore, as the user attempts to move the inner frame relative to the outer frame during an exercise routine, the efforts of the user are opposed by the resistance means.

DETAILED DESCRIPTION OF THE ILLUSTRATED EMBODIMENTS

Figure 1:
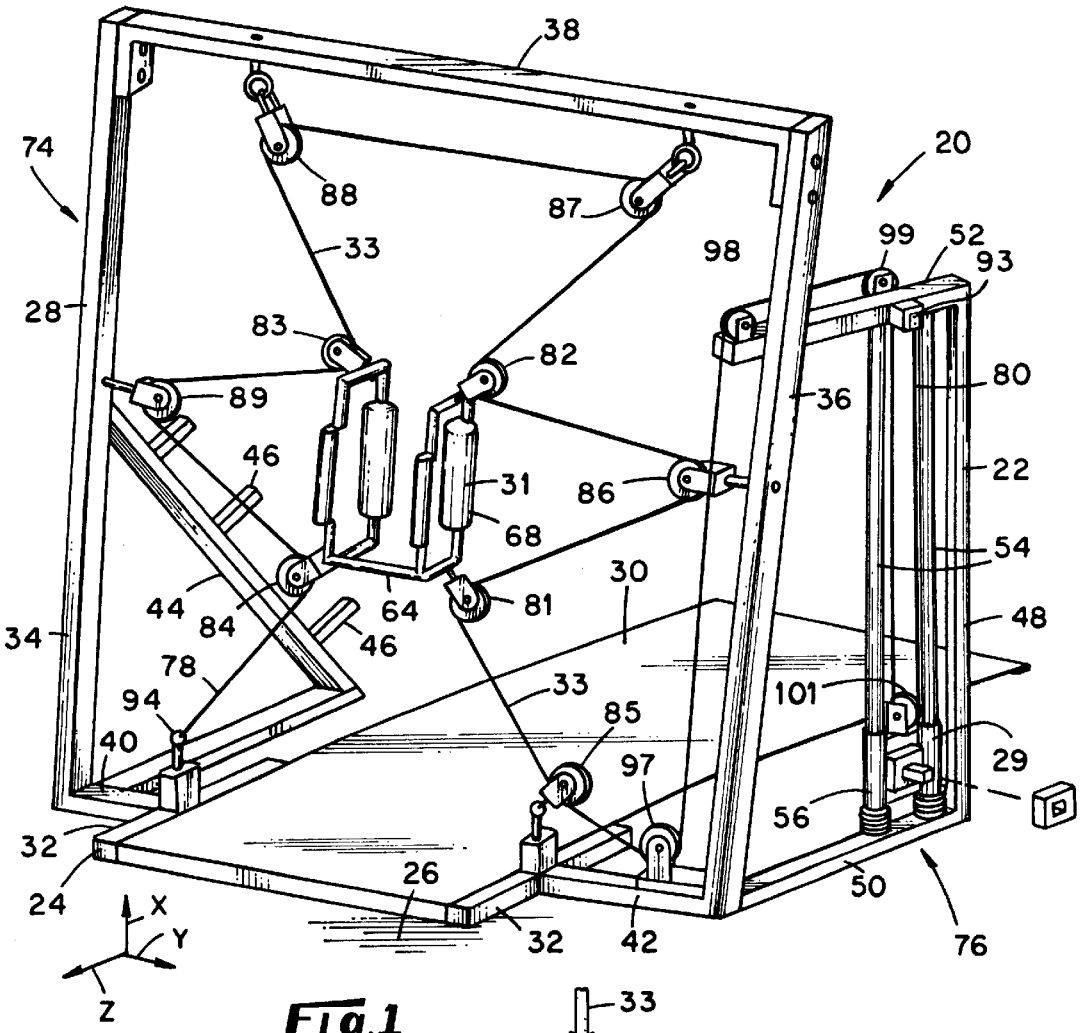
FIG. 1 is a perspective view of an embodiment of an apparatus within which features of the present invention are embodied.

Turning now to the drawings in greater detail, there is shown in FIG. 1 an embodiment, generally indicated 20, of an exercise apparatus within which features of the present invention are embodied. The apparatus 20 includes a base 24 adapted to rest upon a floor 26 or similar underlying support surface and an outer frame 28 joined to so as to extend generally upwardly from the base 24. Associated with the base 24 is an upstanding frame-like assembly 22, and a weight-bearing carriage 29 is mounted for movement upwardly and downwardly along the length of the assembly 22. An inner frame 31 is arranged substantially centrally of the frame 28 and is connected to the weight-bearing carriage 29 by way of a steel cable 33 and an arrangement of pulleys (described herein) so that the inner frame 31 is maintained in a suspended condition by the tensioned condition of the cable 33. As a user pushes against the inner frame 31 during an exercise routine, the cable 33 and pulleys permit the inner frame 31 to move in response to the pushes while the weight-bearing carriage 29 maintains a tension upon the cable 33, and this tensioned condition of the cable 33 opposes the movements of the inner frame 31 during the exercise routine.

The base 24 includes a relatively large piece 30 of sheet metal which overlies the underlying floor 26 and provides a platform or "launch pad" upon which a user stands while using the apparatus 20. In the depicted apparatus 20, the piece 30 is constructed of steel and measures about 4.0 feet in width and 6.0 feet in length, but other construction materials and sizes are acceptable. If desired, the platform piece 30 can be reinforced with steel members 32 joined so as to extend along the underside of the piece 30.

Figure 3:
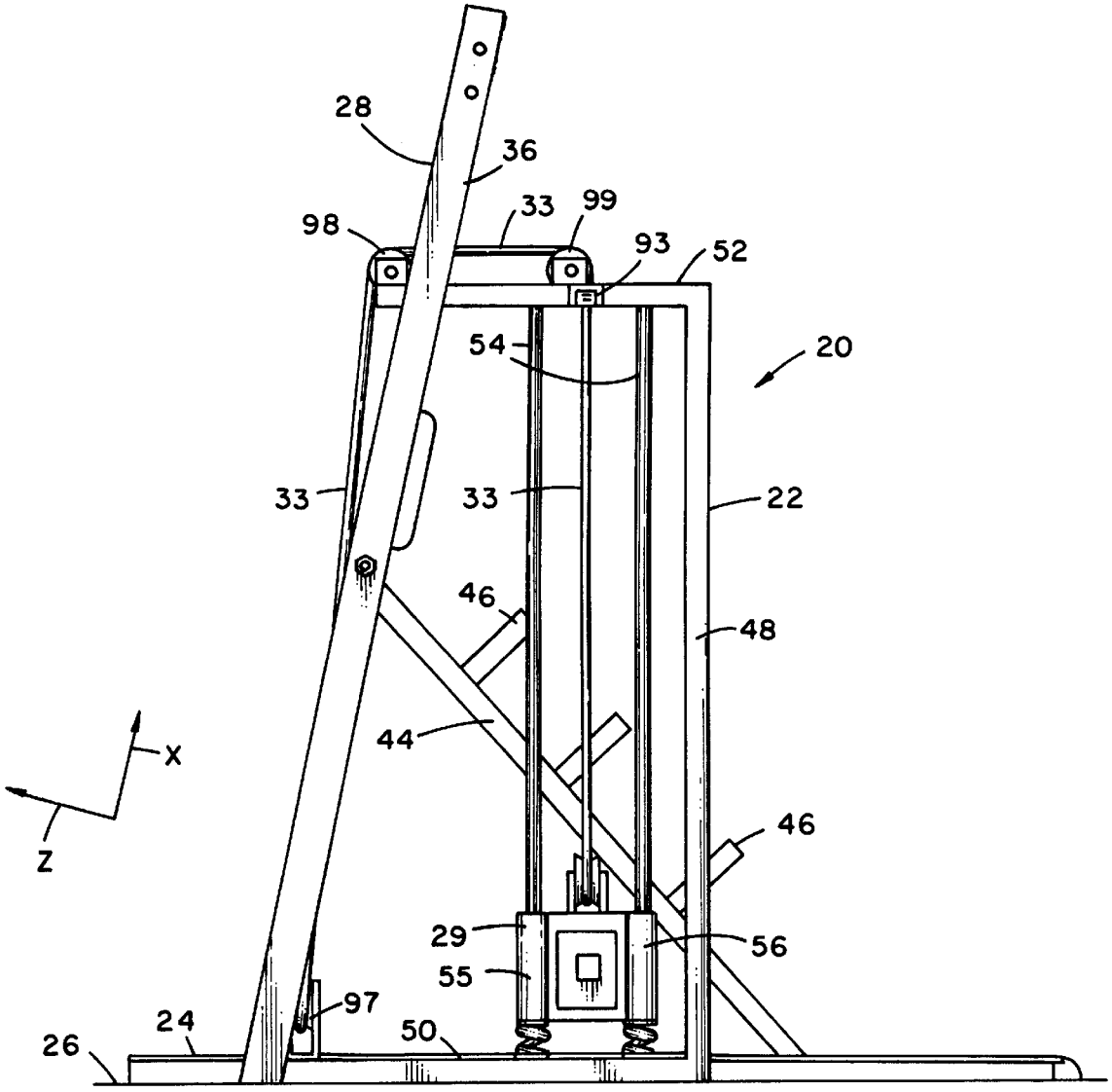
FIG. 3 is a side elevational view of the FIG. 1 embodiment as seen generally from the right in FIG. 1.

The outer frame 28 is somewhat rectangular in form and includes two side posts 34, 36, a top member 38 joining the side posts 34, 36 at the upper end thereof, and two bottom members 40, 42 which join each side post 34 or 36 to a corresponding side of the base 24. The frame 28 is supported in a somewhat canted (i.e. off-vertical) orientation (as best shown in FIG. 3) by means of a brace 44 (FIG. 1) joined to the side post 34 and the aforementioned frame-like assembly 22 joined to the side post 36. Since the side posts 34, 36 and top and bottom members 38, 40 and 42 are arranged substantially in a plane, the entire frame 28 is substantially oriented in a plane as well. The plane of the frame 28 is arranged generally parallel to the depicted X and Y-coordinate axes and perpendicular to the depicted Z-coordinate axis. Each component of the depicted frame section 28 is constructed of steel, but alternative materials can be used.

If desired, a plurality of post sections 46 can be joined atop the brace 44 enabling the brace 44 to function as a weight tree upon which weights (e.g. barbell weights) can be stored until needed for use.

With reference to FIGS. 1 and 3, the frame-like assembly 22 includes a vertical member 48 joined between one end of a lower member 50 and one end of an upper member 52 so as to form a somewhat C-shaped arrangement, and the opposite ends of the members 50, 52 are joined (as with welds) to the side post 36. A pair of parallel rods 54 are also joined between the lower and upper members 50 and 52, and the weight-bearing carriage 29 is positioned about the rods 54. As will be apparent herein, the carriage 29 is intended to bear weights for the purpose of tensioning the cable 33 and is adapted to move vertically along the rods 54 during use of the apparatus 20 as the rods 54 act as parallel guideways which guide the upward and downward movement of the carriage 29.

Figure 5:
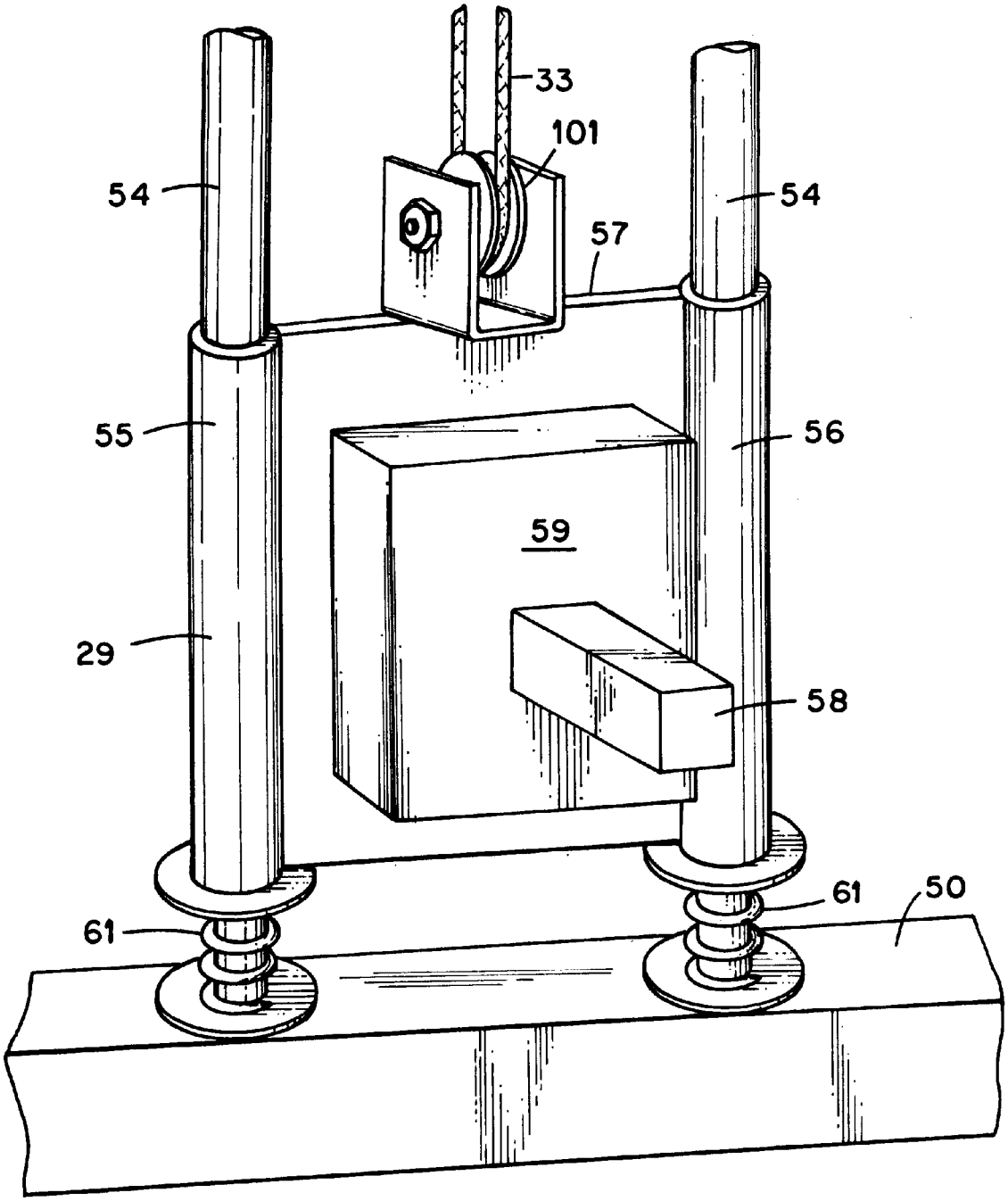
FIG. 5 is a perspective view of another fragment of the FIG. 1 embodiment illustrating the weight-bearing carriage thereof.

In this connection and with reference to FIG. 5, the carriage 29 includes sleeve-like portions 55, 56 positioned about the rods 54 and a central portion 57 which joins the sleeve-like portions 55, 56. A shaft 58 is secured to so as to extend from the central portion 57 for accepting barbell weights 59 positioned thereabout. For cushioning any impact between the carriage 29 and the lower member 50, compression springs 61 can be positioned between the carriage 29 and the lower member 50 along the length of the rods 54.

Figure 2:
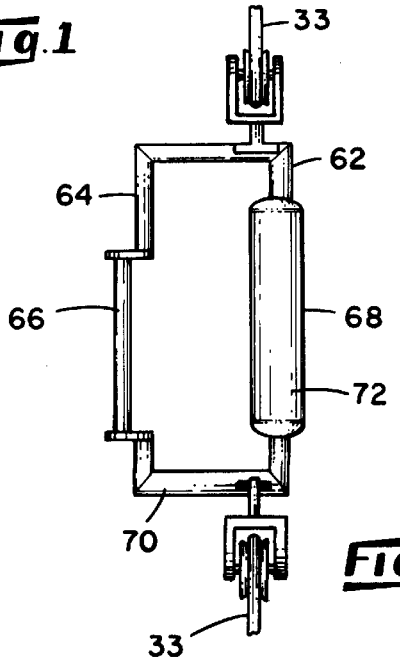
FIG. 2 is a side elevational view of the inner frame of the FIG. 1 embodiment.
Figure 6:
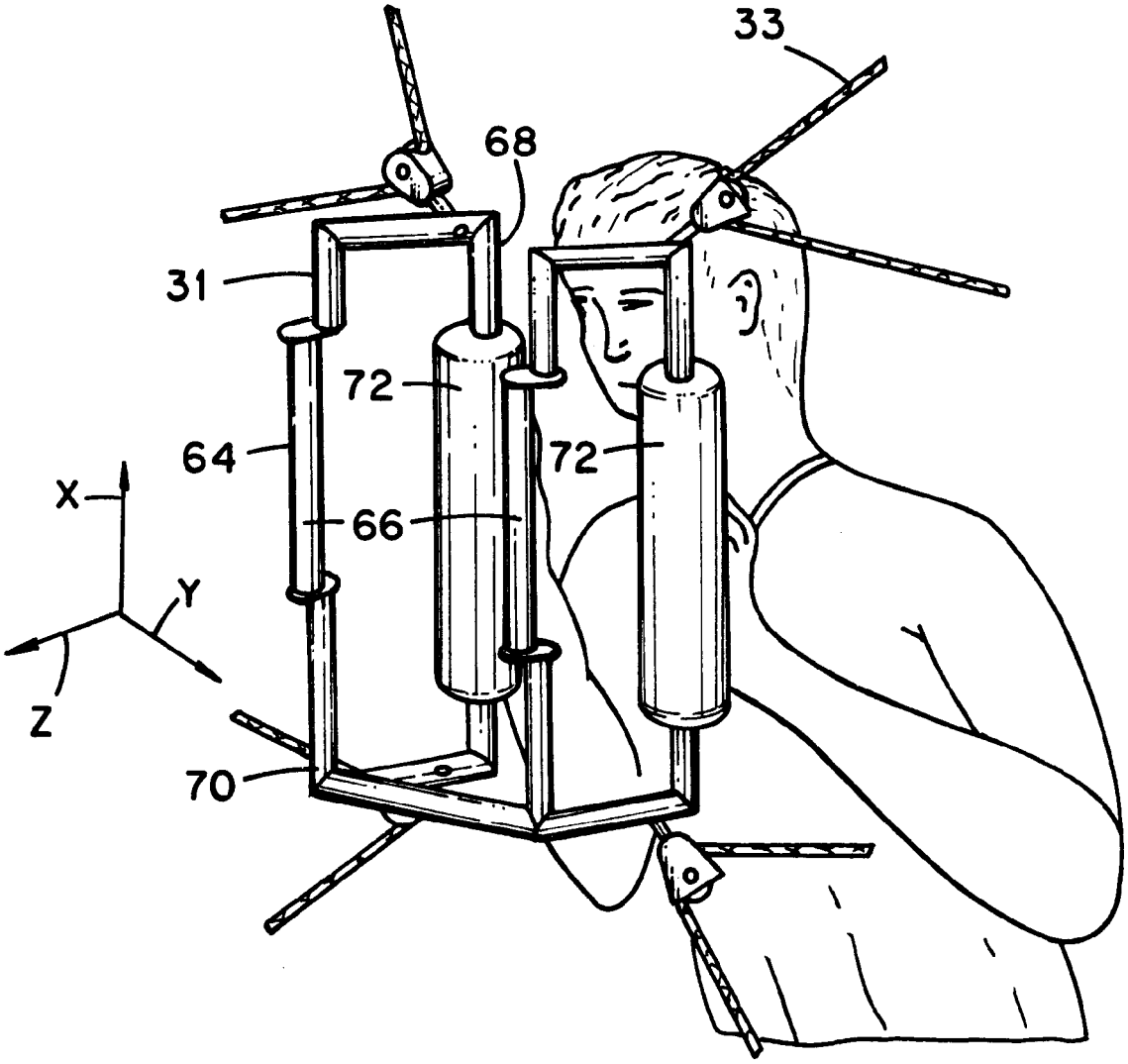
FIG. 6 is a perspective view of the inner frame of the FIG. 1 embodiment shown being pushed upon by a user.

As best shown in FIG. 1, the inner frame 31 of the apparatus 20 is maintained in a substantially central position of rest prior to the use of the apparatus 20 and provides the component of the apparatus 20 which is to be directly acted upon (e.g. pushed upon) by the user during use of the apparatus 20. As best shown in FIGS. 2 and 6, the inner frame 31 of the depicted apparatus 20 is somewhat rectangular and box-like in form having a forward side 64 which is provided with a pair of hand grips 66 whose purpose will be apparent herein and an opposite rearward side 68 against which the user acts as he attempts to move the component inner frame 31 relative to the outer frame 28 and away from the FIG. 1 position of rest. Preferably, the inner frame 31 includes a framework 70 comprised of steel and an amount of padding 72 (constructed, for example, of foam) which is attached to so as to cover the framework 70 provided on the rearward side 68 of the frame 31.

It is a feature of the apparatus 20 that it includes resistance means, generally indicated 74 in FIG. 1, for resisting the user's attempts to move the inner frame 31 relative to the outer frame 28 from its depicted FIG. 1, substantially centered, position of rest within the interior of the frame 28. In the depicted apparatus 20, the resistance means 74 includes the cable 33, introduced earlier, and means, generally indicated 76, for tensioning the cable 33 between its ends 78 and 80. As will be apparent herein, it is the tensioned condition of the cable 33 which maintains the inner frame 31 in a suspended condition within the interior of the frame 28 and opposes the user's attempts to move the inner frame 31 from its substantially central position of rest within the outer frame 28. In particular and as will be apparent herein, the inner frame 31 is capable of being moved from the FIG. 1 position of rest along any of a number of three-dimensional paths having components which extend along the indicated X, Y or Z coordinate axes while the resistance means 74 is connected to the inner frame 31 for resisting the movement of the inner frame 31 relative to the outer frame 28 along such paths.

Figure 4:
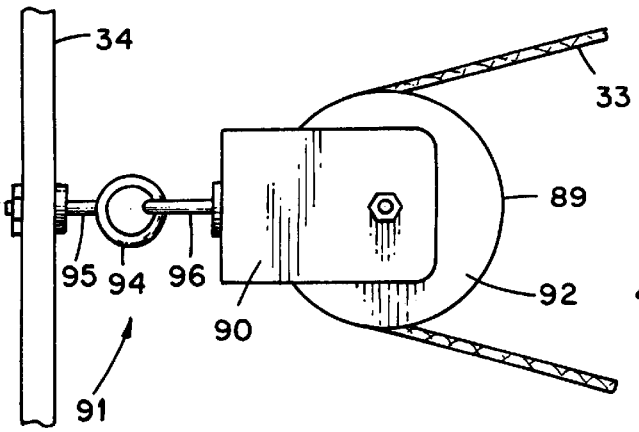
FIG. 4 is a front elevational view of a fragment of the FIG. 1 embodiment illustrating one of the pulleys of the exercise apparatus.

With reference again to FIG. 1, the cable 33 is interwoven between the inner frame 31 and the outer frame 28 in a manner which accommodates a freedom of movement along three coordinate axes within the plane of or out of the plane of the outer frame 28. To this end, the apparatus 20 includes one pulley set comprised of four pulleys 81, 82, 83 and 84 which are attached to the inner frame 31 so that each pulley 81, 82, 83 or 84 is disposed at a corresponding one of the four corners thereof, and the apparatus 20 includes a second pulley set comprised of five pulleys 85, 86, 87, 88 and 89 which are regularly spaced about the interior of the outer frame 28. The pulleys 85, 86, 87, 88 and 89 of the second pulley set are spaced at appropriate intervals along the bottom member 42, the side post 36, the upper member 38 and the side post 34 of the outer frame 28 for a purpose which will be apparent herein. As exemplified by the pulley 89 depicted in FIG. 4, each pulley in the apparatus 20 includes a pair of side plates 90 (only one shown in FIG. 4) between which is journaled a sheave 92, and the side plates 90 are attached to a corresponding member of the outer frame 28 or corner of the inner frame 31 by way of a bearing arrangement 91 comprised of interlocking (steel) loops 94, 96 which permit the pulley to swivel relative to the outer frame 28 or inner frame 31 though a relatively large range of motion. One steel loop 94 is provided by the ring of an eyelet 95.

With reference again to FIG. 1, one end 78 of the cable 33 is anchored to the outer frame 28 by way of the eyelet 95 secured adjacent the base 24, and the other end 80 of the cable 33 is anchored to the upper member 52 of the frame-like assembly 22. More particularly, a cable-accepting boss 93 is affixed to the upper member 52 of the frame-like assembly 22, and the cable end 80 is affixed within the boss 96 with set screws.

As a path is traced along the cable 33 from the end 78 thereof, the cable 33 is routed across the sheave of the pulley 84, then across the sheave of the pulley 89, across the sheave of the pulley 83, across the sheave of the pulley 88, then across the sheave of the pulley 87, across the sheave of the pulley 82, then across the sheave of the pulley 86, across the sheave of the pulley 81, across the sheave of the pulley 85, then in sequence across the sheave of additional pulleys 97, 98 and 99, and then across the sheave of the pulley 101 associated with the weight-bearing carriage 29 then upwardly to the boss 93. The additional pulleys 97, 98 and 99 are affixed at appropriate locations along the outer frame 28 and the inner frame 31 for the purpose of routing the cable 33 between the pulley 85 and the weight-bearing carriage 29. It will be understood that the cable 33 is sized in length and the weight-bearing carriage 29 possesses sufficient weight so that until moved, the inner frame 31 is maintained in a substantially central position of rest within the interior of the outer frame 28 by the tension exerted thereupon by way of the aforementioned pulleys and cable 33 and the weight-bearing carriage 29 is positioned in a lowermost position upon the rods 54.

When the inner frame 31 is sufficiently moved from its FIG. 1 position of rest out of the plane of the outer frame 28, the cable 33 is sufficiently tensioned between its ends 78 and 80 to effect the upward movement of the weight-supporting carriage 29 along the rods 54. As a general rule, the greater the distance that the inner frame 31 is moved out of the plane of the outer frame 28 (i.e. relative to the X-Y plane), the greater the distance that the carriage 29 is moved upwardly along the rods 54 by the cable 33. It follows, of course, that as the inner frame 31 is moved from its FIG. 1 position of rest, the cable 33 is maintained in tension between its ends 78, 80 and resists the movement of the inner frame 31 in this manner. Furthermore, the aforedescribed pulley/cable arrangement permits the inner frame 31 to be shifted within the plane of the outer frame 28 (i.e. relative to the Z-axis) while the cable 33 is maintained in a tensioned condition between its ends 78, 80 so that the cable 38 maintains a desirable resistance to movement of the inner frame 31 along the X and Y axis as well.

To use the apparatus 20, a user stands upon the base 24 of the apparatus 20 and acts against the inner frame 31 as he attempts to move the inner frame 31 relative to the outer frame 28. More specifically and with reference to FIG. 6, the user pushes upon the padding 72 secured to the rearward side 68 of the frame 31 with his hands or forearms to urge the inner frame 31 along either a forward, downward, rightward or leftward direction or a combination of such directions. If desired, the user may act against the inner frame 31 in a manner which simulates the motions of a blocker of a football team as the blocker attempts to block a defenseman. Accordingly, the apparatus 20 is believed to be well-suited for developing the blocking skills of a football player. If desired, additional resistance to movement of the inner frame 31 can be manually applied to the inner frame 31 by a partner (or coach) who grasps the hand grips 66 disposed on the forward side 64 of the inner frame 31.

Figure 7:
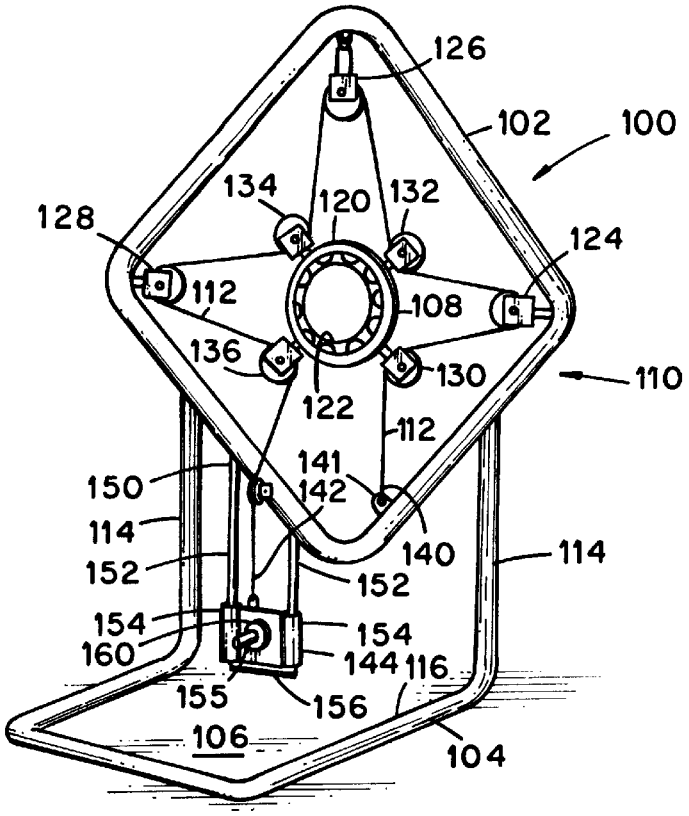
FIG. 7 is a perspective view of another embodiment of an apparatus within which features of the present invention are embodied.
Figure 8:
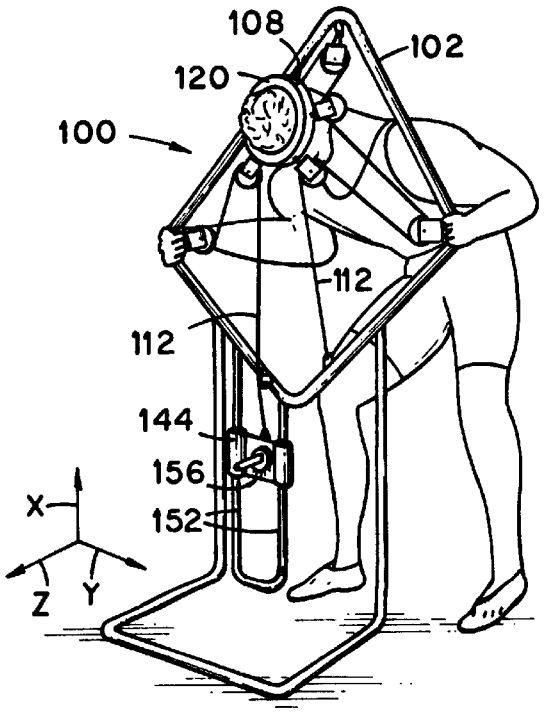
FIG. 8 is a view of the FIG. 7 apparatus shown being used by a user.

With reference to FIGS. 7 and 8, there is illustrated an alternative embodiment, generally indicated 100, of an exercise apparatus within which features of the present invention are embodied. The apparatus 100 includes an outer frame 102 and an associated base 104 supportable in a stationary condition upon a floor 106 and an inner frame 108 arranged substantially centrally of the outer frame 102. Resistance means 110 including a tensioned cable 112 is passed between the inner frame 108 and the outer frame 102 in an interwoven arrangement to accommodate relative movement between the inner and outer frames 108 and 102 yet resist relative movement therebetween. The depicted apparatus 100 is believed to be well-suited for strengthening the neck muscles of a user.

The outer frame 102 is tubular in construction and formed within a plane to resemble a diamond-like shape. The inner frame 108 includes an oval-shaped ring 120 and an arrangement 122 of padding secured to the interior of the ring 120. As will be apparent herein, the ring 120 is sized to accept the head of a user inserted therein, and the padding arrangement 122 is intended to provide a cushion between the user's head and the interior of the ring 120. Accordingly, the padding arrangement 122 may be constructed out of soft leather or other suitable materials.

One pulley set comprised of pulleys 124, 126 and 128 is attached to the outer frame 102 (adjacent the corners thereof) and arranged in spaced relationship about the inner frame 108. A second pulley set comprised of pulleys 130, 132, 134 and 136 is attached to the inner frame 108 and arranged in spaced relationship thereabout.

The cable 112 has two opposite ends 140 and 142, and one end 140 is anchored to the outer frame 102 adjacent the lowermost corner thereof by way of a suitable hook 141. From the cable end 140, the cable 112 is routed in sequence through the pulley 130, through the pulley 124, through the pulley 132, through the pulley 126, through the pulley 134, through the pulley 128, and then through the pulley 132, and then through the pulley 126. The opposite end 142 of the cable 112 is attached to a weight-bearing arrangement 144 suspended below the outer frame 102. A guide track arrangement 150 including two vertically-oriented and parallel guide rods 152 is attached beneath the outer frame 102, and the weight-bearing carriage 144 has two sleeve-like portions 154 which are positioned about the rods 152 to accommodate an upward and downward sliding movement thereabout. The carriage 144 also includes a central portion 156 joining the sleeve-like portions 154 and including a protruding shaft 155 to which barbell weights 160 can be added or removed. The weight of the weight-bearing carriage 144 is sufficient to tension the cable 112 into a relatively taut condition and so that the inner frame 108 is suspended substantially centrally of (and substantially in a coplanar condition with) the outer frame 102.

To use the apparatus 100 and with reference to FIG. 8, the user initially inserts his head into the padding arrangement 122 of the inner frame 108. With his hands gripped about the tubular frame 102 on opposite sides thereof for stability, the user then moves his head along a desired path (e.g. either forwardly, rightwardly and leftwardly, or up and down) relative to the outer frame 102. Thus, the inner frame 102 can be moved in any of a number of directions within the plane of the outer frame 102 or out of the plane of the outer frame 102 (i.e. along any of a number of or along a combination of the indicated X, Y and Z coordinate directions).

As the inner frame 108 is moved relative to the outer frame 102 as aforedescribed, the tension maintained upon the cable 112 opposes the movement of the inner frame 108 relative to the outer frame 102 from an initial position (i.e. the FIG. 7 position) of rest and therefore provides a strong resistance to the attempted movement of the inner frame 108 by the muscles of the user. When the inner frame 108 has been moved away from the FIG. 7 position of rest by a sufficient amount (as along the indicated Z-coordinate axis), the cable 112 pulls the weight-bearing carriage 144 upwardly from its lowermost location along the guide rods 152. The permitted length of movement of the carriage 144 upwardly along the rods 152 accommodates a relatively large range of movement of the inner frame 108 relative to the outer frame 102. For enhanced muscular development, the head of the user is preferably moved in directions which urge the inner frame 108 away from the FIG. 7 position of rest to a second position and then permit the inner frame 108 to slowly return toward the position of rest while the user's muscles exert a resistance to the movement of the inner frame 108 toward the FIG. 7 position of rest.

It follows from the foregoing that embodiments 20 and 100 of an exercise apparatus have been described herein which employ inner and outer frames arranged in a substantially concentric relationship and which employ tensioning means including a tensioned cable which is passed between locations of the inner frame and the outer frame for maintaining the inner frame in a substantially central position within the outer frame when the inner frame is in a position of rest. Furthermore, the tensioned condition of the cable resists movement of the inner frame relative to the outer frame from its position of rest. The cable is anchored to a weight-bearing carriage at its other end for maintaining a tension upon the cable as aforedescribed, and the weight-bearing is adapted to slide vertically along the length of a guide track to accommodate a large range of movement of the inner frame relative to the outer frame.

It will be understood that numerous modifications and substitutions can be had to the aforedescribed embodiment without departing from the spirit of the invention. Accordingly, the aforedescribed embodiments are intended for the purpose of illustration and not as limitation.

We claim:

1. An exercise apparatus comprising:

an inner frame having a center;

an outer frame which generally encompasses the inner frame and which is positionable in a stationary condition with respect to a support surface disposed adjacent the apparatus;

a first set of pulleys supported by the outer frame and arranged at locations which are spaced about the inner frame so as to surround the inner frame and wherein the spaced locations are arranged generally within a common plane;

a second set of pulleys supported by the inner frame and arranged at locations which are positioned about the inner frame so as to surround the inner frame and wherein the positioned locations are arranaed generally inboard of the locations at which the first set of pulleys are arranged;

a cable which is passed between the pulleys of the first and second set of pulleys in an interwoven arrangement and has two opposite ends, and one end of the cable is anchored to the outer frame; and means for tensioning the cable between its opposite ends including means attached to the end of the cable opposite the anchored end to exert a tension upon the cable between the ends thereof and to thereby exert an outward pull upon the inner frame from the center thereof so that the inner frame is suspended generally within the common plane when positioned in a position of rest and wherein the tension of the cable resists movement of the inner frame relative to the outer frame from said position of rest and out of said common plane so that when the inner frame is forced from said position of rest and out of said common plane during an exercise routine, the tension of the cable biases the inner frame toward the position of rest and thereby opposes movement of the inner frame relative to the outer frame.

2. The apparatus as defined in claim 1 wherein the pulleys and cable cooperate to permit three-dimensional movement of the inner frame relative to the outer frame from the position of rest.

3. The apparatus as defined in claim 2 wherein there are at least three pulleys in the first set of pulleys which are spaced about the inner frame, so as to surround the inner frame and there are at least three pulleys in the second set of pulleys which are spaced about the inner frame, so as to surround the inner frame.

4. The apparatus as defined in claim 1 wherein the one of the cable ends is anchored to the outer frame, and the tensioning means includes weights attached to the other end of the cable to thereby tension the cable between its ends.

5. The apparatus as defined in claim 4 further comprising a substantially vertically-disposed guide track associated with the outer frame and a weight-bearing carriage mounted for sliding movement upwardly and downwardly along the length of the guide track, and the other end of the cable is exposed to the weight of the weight-bearing carriage so that the weight thereof continually tensions the cable between its ends and so that movement of the inner frame from its position of rest toward the second position effects a movement of the weight-bearing carriage generally upwardly along the guide track.

6. The apparatus as defined in claim 5 wherein the weight-bearing carriage includes a shaft to which barbell weights can be added or from which barbell weights can be removed so that the strength of the tension exerted between the ends of the cable can be altered.

7. The apparatus as defined in claim 1 wherein the outer frame includes a base which is adapted to be positioned in a stationary condition upon a floor or other support surface.

8. An exercise apparatus comprising:

an outer frame positionable in a stationary condition with respect to a support surface and including an interior;

an inner frame arranged within the interior of the outer frame and including a center;

a first set of pulleys supported by the outer frame and arranged at locations which are spaced about the inner frame so as to surround the inner frame and wherein the spaced locations are arranged generally within a common plane;

a second set of pulleys supported by the inner frame and arranged at locations which are positioned about the inner frame so as to surround the inner frame and wherein the positioned locations are arranged generally inboard of the locations at which the first set of pulleys are arranged;

a cable which is passed between the pulleys of the first and second set of pulleys in an interwoven arrangement and has two opposite ends, and one end of the cable is anchored to the outer frame; and means for tensioning the cable between its opposite ends including means attached to the end of the cable opposite the anchored end so that a tension is exerted upon the cable between the ends thereof and an outwardly-directed pull is thereby exerted upon the inner frame from the center thereof so that the inner frame is suspended generally within the common plane when positioned in a suspended position of rest and wherein the tension of the cable resists movement of the inner frame relative to the outer frame from said suspended position of rest and out of said common plane so that any movement of the inner frame from said suspended position of rest during an exercise routine is opposed by the tension of the cable.

9. The apparatus as defined in claim 8 wherein the one of the cable ends is anchored to the outer frame, and the tensioning means includes weights attached to the other end of the cable so that the weight thereof tensions the cable between its ends.

10. The apparatus as defined in claim 9 further comprising means associated with the outer frame providing a substantially vertically-disposed guide track and a weight-bearing carriage mounted for sliding movement upwardly and downwardly along the length of the guide track, and the other end of the cable is exposed to the weight of the weight-bearing carriage so that the weight thereof continually tensions the cable between its ends and so that movement of the inner frame from its position of rest effects a movement of the weight-bearing carriage generally upwardly along the guide track.

11. The apparatus as defined in claim 10 wherein the guide track-providing means includes a pair of parallel guide rods supported in a substantially vertical orientation and the weight-bearing carriage is mounted upon the guide rods for sliding movement therealong.

12. The apparatus as defined in claim 10 wherein the weight-bearing carriage includes a shaft to which barbell weights can be added or from which barbell weights can be removed so that the tension exerted between the ends of the cable can be altered.

13. The apparatus as defined in claim 8 wherein the outer frame includes a base which is adapted to be positioned in a stationary condition upon a floor or other support surface.

* * * * *